US010533300B1

(12) United States Patent
Armas

(10) Patent No.: US 10,533,300 B1
(45) Date of Patent: Jan. 14, 2020

(54) AUTOMATIC GRADER STABILIZER

(71) Applicant: David Armas, Homestead, FL (US)

(72) Inventor: David Armas, Homestead, FL (US)

( * ) Notice: Subject to any disclaimer, the term of this patent is extended or adjusted under 35 U.S.C. 154(b) by 0 days.

(21) Appl. No.: 16/055,094

(22) Filed: Aug. 4, 2018

(51) Int. Cl.

| | |
|---|---|
| ***E02F 3/84*** | (2006.01) |
| ***E02F 3/815*** | (2006.01) |
| ***E02F 3/76*** | (2006.01) |
| ***E02F 3/34*** | (2006.01) |
| ***E02F 3/96*** | (2006.01) |

(52) U.S. Cl.
CPC ..... *E02F 3/8157* (2013.01); *E02F 3/3414* (2013.01); *E02F 3/7618* (2013.01); *E02F 3/844* (2013.01); *E02F 3/962* (2013.01)

(58) Field of Classification Search
CPC ..... E02F 3/844; E02F 3/962
USPC ..... 172/779, 812, 822
See application file for complete search history.

(56) References Cited

U.S. PATENT DOCUMENTS

| | | | | |
|---|---|---|---|---|
| 4,189,010 A * | 2/1980 | Meisel, Jr. | E02F 3/7613 | 172/822 |
| 5,127,172 A * | 7/1992 | Lund | E02F 3/815 | 37/403 |
| 5,435,117 A * | 7/1995 | Eggena | A01D 34/27 | 56/10.2 D |
| 6,988,866 B2 * | 1/2006 | Friedland | B66F 9/12 | 37/405 |
| 8,118,111 B2 * | 2/2012 | Armas | E02F 3/3414 | 172/779 |

* cited by examiner

*Primary Examiner* — Gary S Hartmann
(74) *Attorney, Agent, or Firm* — Christopher J. VanDam, PA; Chris Vandam

(57) ABSTRACT

A method of stabilizing a small to mid-sized skid steer vehicles used to grade earth using a dozer blade in conjunction with GPS automatic grade control equipment. The main arm of the skid steer is retained at a specific height and the hydraulic controlling the main arm is limited. The height of the dozer blade is raised and lowered by affecting the pitch axis of movement of the blade and not by raising and lowering the main arm. The device is most suited to skid steer vehicles capable of using a variety of interchangeable front end accessories in addition to a dozer blade.

4 Claims, 4 Drawing Sheets

AUTOMATIC GRADER STABILIZER

BACKGROUND OF THE INVENTION

1. Field of the Invention

The present invention relates to earth moving equipment, and more particularly, to an improved earth moving grader stabilizer.

2. Description of the Related Art

Several designs for improvements to earth moving equipment have been designed in the past. None of them, however, includes a device that stabilizes an earth moving grader blade of small to medium-sized track-steer or skid-steer vehicles using a remote grade controller system.

Applicant believes that the closest reference corresponds to U.S. Pat. No. 8,118,111 issued to Armas. However, it differs from the present invention because the Armas method attempts to stabilize the dozer blade by a brackets locking the pitch axis movement of the dozer blade with a bracket locking relative movement between the main arm of the vehicle and the attachment comprising the dozer blade assembly. The Armas prior art maintains the full movement of the main arm of the vehicle to raise and lower the attachment assembly including the dozer blade.

The limitations of this method rests in the requirement for the automatic grading system to finely adjust the grade height of the blade by using the large hydraulics of the main arm to lift and lower the entire dozer blade assembly along with the up and down movements of the main arm. This creates a lot of weight being moved continually up and down as the blade automatically is adjusted by the automatic grade system which has the limitations of using significant power, imparting stress on the greater structure of the skid steer vehicle, slows movement with greater mass being moved and reduces the fineness of the resolution that the cutting edge of the blade can be held during automatic grading operations.

The Armas system is very effective when used with an automatic laser grading systems as disclosed in his '111 patent. The laser system is guided by a laser receiver mast affixed to the dozer blade to measure and calibrate the controlled movements of the vertical position of the dozer blade during automatic grading operations. For this to be effective the blade must generally be held vertically to ensure that the laser mast is generally vertical. Tilting of the mast off from a vertical position would impart an error to the system causing the automatic controller to misinterpret the actual height of the bottom of the dozer blade relative to the earth being moved.

However, with the advent of higher resolutions with the wide area augmentation system global positioning system (WAAS-GPS) the laser mast is no longer required in all automatic grading systems. The limitation created by a tilting mast that can confuse the accuracy of a laser grading system is no longer a factor for these systems. The location of the blade can be derived by satellite and the height of the blade calibrated for consistent and accurate automatic grading.

The present device and method stabilizes the dozer blade attachment assembly by limiting the main arm of the vehicle axis of movement. This provides a stable platform for the dozer blade attachment assembly that in turn which permits greater control of the blade and stabilizes the blade for more precise control. This and other features are described in more detail below.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a device that grades a wide variety of soil types and site conditions in a highly accurate way.

Another object of the present invention is to provide a stable platform on a medium to small skid steer vehicle that does not need the use of a laser mast affixed to the dozer blade but instead adapts the vehicle to be suitable for GPS automatic laser grading systems.

It is another object of the present invention that does not require any additional ground contacting stabilizers.

It is another object of this invention to provide a device that can maneuver in restricted space and around sensitive objects and substrates.

It is still another object of the present invention to provide greater functionality to small to medium skid steer and track steer vehicles while retaining their ability to be used with the wide variety of available accessories.

It is yet another object of this invention to provide such a device that is inexpensive to manufacture, light weight and easy to maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
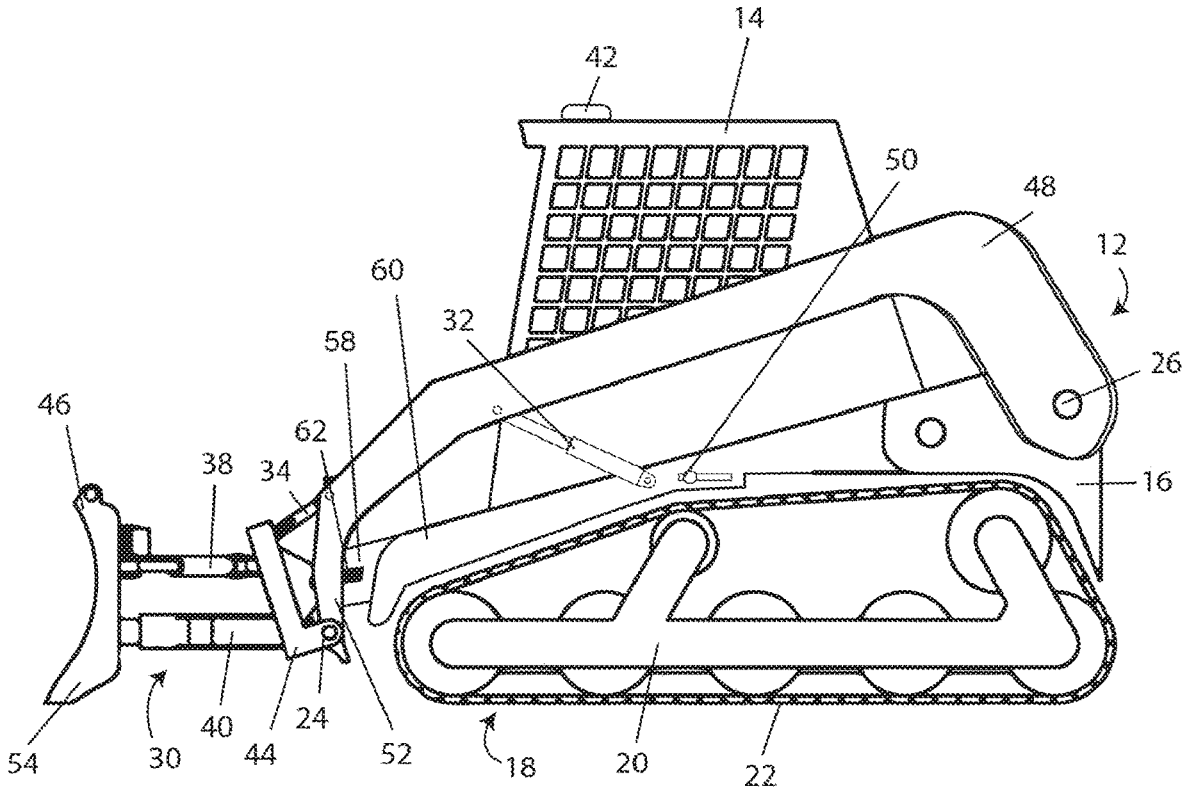
FIG. 1 is a side elevation view of a track steer vehicle with a dozer blade in a lower position.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the dozer, the automatic grader, the skid steer, the bracket, the GPS grader, the machine, the system, the method or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Skid steer vehicles are commonly commercially available. The skid steer vehicle that is preferred to work with the present device is small to medium sized and designed to accept any of a variety of front end accessories such as a dozer blade, pallet forks, a mower, a hole digger and several others. These front end accessories can be interchanged relatively easy with one or two men in a few minutes. The popularity of the small to medium sized skid steer class of vehicle is owed largely to the availability of the front end accessories by allowing a single vehicle to accomplish a wide variety of tasks without the need for specialty vehicles.

Grade control systems, such as laser automation, are commonly commercially available. Many early systems worked with a laser reference beacon erected on an edge of a job site at a known location and elevation established by survey. A laser receiver is attached to earthmoving equipment, typically onto the ground contacting blade, and sends a signal to a computer accessible to the operator of the earthmoving equipment. The computer is able to determine if the blade is above or below the desired grade and make adjustments as necessary to the blade height by controlling the hydraulics that move the blade.

However, the automatic grade control systems have evolved to utilize highly accurate GPS signals in combination with computer control modules to automate the height of the dozer blade as the vehicle moves over the job site. Laser control masts are no longer needed to maintain the accuracy of earlier machines.

With the prior art laser control systems the dozer blade supported the laser control receiver mast. This mast had to be held upright, nearly vertical, consistently so that the system could use the top of the mast as a datum for referencing the height of the bottom of the dozer blade the defined the grade being made as the dozer moved over the earth defining the new grade.

Earlier solutions kept the blade and therefore the laser mast vertical by preventing the pitch axis of movement of the dozer blade. This kept the mast vertical. However, the height of the dozer blade was then controlled by the vertical movement of the main arm that also carried the entire dozer blade assembly.

The dozer blade assembly with the several hydraulic actuators, dozer blade, hoses, frame and other elements, along with the main arm itself is very heavy. This uses substantial energy to move and has a potential for slowed and jerky movements that can affect the precision and smoothness of the grade.

The solution generally is found when the laser mast is no longer needed because GPS has been employed to control the automatic grade computer location and the required grade relative to that location. Without the laser mast the dozer blade, previously restricted in pitch movement, can now be freed to adjust as necessary to control the bottom of the dozer blade defining the surface grade.

However, it has been determined through much trouble and experimentation that when the main arm is available to control the height of the bottom of the dozer blade while the pitch axis of the blade is simultaneously adjusting the height of the bottom of the blade that a consistent grade cannot be consistently achieved. This is particularly so when there are varying densities of soil substrates that are being graded with the dozer blade.

A solution at the heart of the present invention is to secure the height of the main arm so that when the dozer blade is vertical the bottom of the dozer blade is at a predetermined height relative to the preexisting grade as generally defined as the plane on which the dozer tracks ride.

With the advent of highly accurate GPS and related positioning systems the laser reference is no longer needed to be affixed to the top of the blade. This now allows the pitch axis, or forward tilt of the dozer blade to be moved without adversely affecting a laser control system and thereby freeing earlier limitations.

Referring now to the drawings, where the present invention is generally referred to with numeral 10, it can be observed that it basically includes a tractor assembly 12, an operator cage 14, an engine case 16, a track assembly 18, a suspension 20, a track 22, a hinge 24, a hinge 26, a hinge 28, a blade assembly 30, a hydraulic 32, a hydraulic 34, a hydraulic 36, a hydraulic 38, a frame 40, an antennae 42, a frame 44, a blade 46, a main arm 48, a valve 50, a front 52, a bottom 54, a bracket 56, a stop 58, a body 60 and a lock 62 and a leveler assembly 80.

Said tractor assembly 12 comprises, inter alia, an operator cage 14 and an engine case 16. An operator of the vehicle sits inside of and operates the vehicle from inside the operator cage 14. An engine inside the engine case 16 typically powers the vehicle including any hydraulics and an electrical system that powers the native on-board computer control system of the skid steer. Essentially the electronic controls of modern skid steer vehicles are fly-by-wire. Electrical inputs from a joystick are processed by the native computer and operate a system of solenoids, actuators, valves and other components to then control the hydraulic system that ultimately supplies the force to move the various elements of the skid steer and the operative attachments, such as a dozer blade assembly.

Said track assembly 18 comprises, inter alia, a suspension 20 and a track 22. In most applications a track steer vehicle will have complementary track assemblies 18 on both sides of the vehicle. The present system will work equally well on a wheeled vehicle and is not dependent on the form that the small earth moving vehicle embodies. However, a skid steer is commonly utilized with the present invention on many job sites and is well suited to move earth.

Said blade assembly 30 comprises, inter alia, a hydraulic 32, a hydraulic 36, a hydraulic 38, a frame 40, a bracket 42, a frame 44, a blade 46 and a main arm 48. The blade assembly 30 can generally be removed from the skid steer to use another attachment, as noted above.

Some users of the present system find it so indispensable that efforts are taken to permanently affix the blade assembly 30 to the skid steer and essentially make it a one purpose vehicle. Some of these adaptions use welding to affix the blade assembly to the front of the skid steer. The remaining axis of movements should be retained so that the automatic grade system keeps the full functionality with which it was designed to use.

FIG. 1 is an elevation view of a skid steer vehicle with a blade assembly 30 attached operatively to the front. Importantly, the front 52 of the main arm 48 is resting on the stop 28. This positions the main arm 48 in the lower most position. The main arm 48 cannot go lower because the stop 28 limits its downward movement.

The stop 28 is located on the body 60 of the skid steer or other location where the stop 28 is determined to intersect the front 52 or other part or bracket associated with the main arm 48 to limit its movement. Essentially the main arm 48 rests with the weight of the main arm 48 securely held by the stop 28.

The combination of stop 28 resting on the front 52 is merely enabling and exemplary of any combination where the main arm 48 bottoms out on a structure that supports the weight of the main arm 48 so that the main arm 48, and the blade assembly 30 affixed thereto so that the bottom 54 of the blade 46 is at a selected height relative to the level of the ground upon which the tracks 22 are supported.

Figure 2:
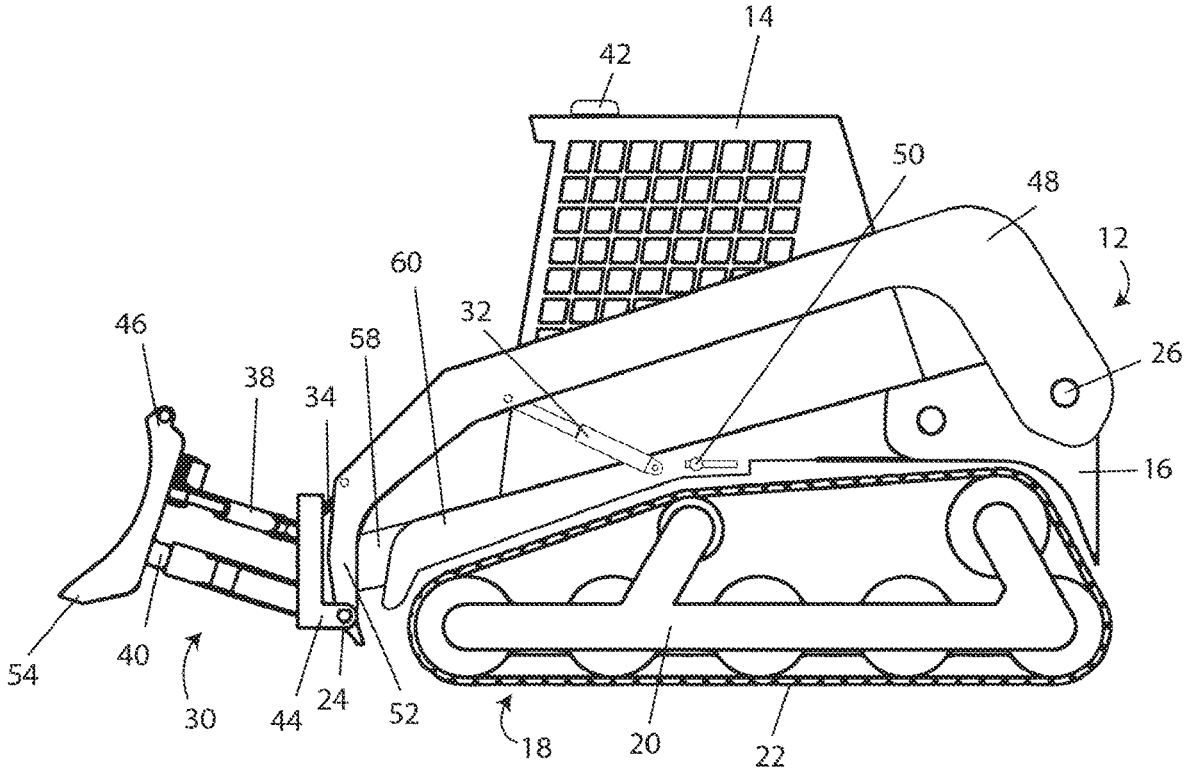
FIG. 2 is a side elevation view of a track steer vehicle with a dozer blade in an upper position.

As seen in FIGS. 1 and 2, when the main arm 48 is fully down the main arm 48 is against the stop 28 and locked against the stop with the lock 62. The lock 62 connects the main arm 48 (or an appendage thereto) against the body 60 (or appendage thereto) so that the main arm 48 is unable to move up or down. To further inhibit movement of the main arm 48, when the lock 62 is secure the valve 50 providing hydraulic pressure to the hydraulic 32 to move the arm is closed effectively stopping any movement of the main arm 48 by an additional means.

By having the valve 50 present the machine can easily be reconfigured with an alternate front attachment that utilizes the movement of the main arm 48, for example, a dump bucket, auger or any other attachment. When the other attachment is connected the valve 50 is simply opened and the lock 62 is removed and full functionality of the main arm 48 is restored.

With the valve 50 the user contemplates returning the skid steer to function with attachments other than only the dozer blade. In accord with this intent, the lock 62 is preferably also unlockable to free the movement of the main arm 48. The lock may therefore be comprised of a bracket like structure removably fixing the main arm 48 in position. Similarly, the lock 62 could manifest as a pinning system, bolting system or other similar means to connect the main arm 48 with the body 60 ans substantially preventing movement of the main arm 48 when the lock 62 is secured and the hydraulic 32 is rendered ineffective.

In some versions of the application of the inventive concept the valve 50 is not needed because the operator of the vehicle opts to dedicate the machine more fully to the GPS automatic grading. In this option, the hydraulic 32 is disconnected by capping the supply and or return hydraulic lines that feed hydraulic 32. This effectively stops any motive force affecting the raising and lowering the main arm 48 so the lock 62 secures the main arm 48 unopposed. With the hydraulic supply to hydraulic 32 removed there is no need for a valve 50.

In yet another variation that fully and essentially permanently dedicates the machine to GPS automatic grading the main arm 48 may be welded to the body or other structure of the vehicle to permanently lock the main arm 48 in place. The hydraulics 32 affecting the main arm 32 may be disabled or removed entirely. This option may be attractive to some users because it may be cheaper to install if the skid steer will never be used with the main arm 48 functional. In this version lock 62 would also be unnecessary because the weld would hold the main arm 48 in a secure position.

Referring now to FIG. 2 where the same vehicle is shown as in FIG. 1 but now shows the hydraulic 34 in a contracted configuration compared to the extended mode in FIG. 1. The difference between FIGS. 1 and 2 is exaggerated in these renderings to show that by changing the degree to which the hydraulic 34 is extended or retracted that the distance that the bottom 54 of the blade 46 lowers or raises relative to the plane of the ground defined by the bottom level of the tracks.

It is exactly this movement of the bottom 54 of the blade up and down that controls the depth of the cut of the blade as controlled by the automatic GPS grading computer. In the prior art the main arm had to lift the whole blade assembly 30 to move the bottom 54 up and down. Now, with the main arm 48 locked only the pitch up of the blade 46 affects how deep the blade 46 cuts the soil. The GPS computer controls this depth and thereby controls the grade that the machine levels the soil. Notice how the weight of the main arm 48 no longer is needed to move with the rest of the blade assembly 30 when the height of the bottom 54 is manipulated by the automatic grading computer.

As the hydraulic 34 picks up and lowers the blade 46 and its bottom 54 the entire blade assembly 30 is articulated about hinge 24. The roll and yaw movements described below are still maintained effective and can also be optionally controlled by the automatic grading computer system independent of the pitch axis of movement.

It should be appreciated that there are alternative configurations of equivalents of the blade assembly 30 than the illustration provided with this specification. In some, the entire blade assembly 30 may not lift and lower with the pitch hydraulic 34 because the pitch hydraulic 34 may be, for example, directly connected to the blade 46 so that fewer elements than the whole blade assembly 30 must be moved together. The inventive concept includes that the main arm 48 is not responsible for the lifting of the bottom 54 but instead is the hydraulic, functionally similar to hydraulic 34, that controls the pitch movement of the blade 46 that has the effect of altering the height of the bottom 54.

Figure 3:
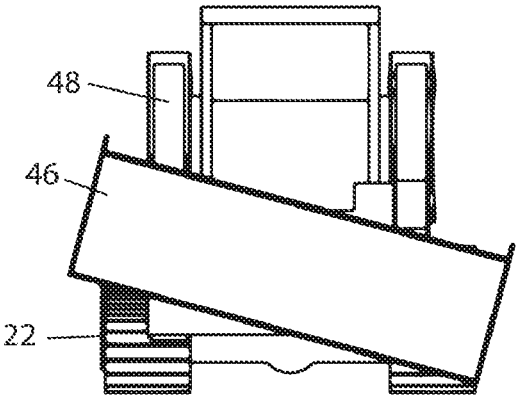
FIG. 3 is a front elevation view demonstrating blade roll counter clockwise.
Figure 4:
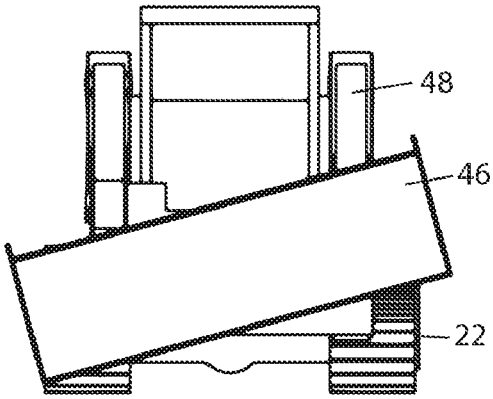
FIG. 4 is a front elevation view demonstrating blade roll clockwise.

Now referring to FIGS. 3 and 4 where a front elevation view of a skid steer vehicle with a dozer blade attachment is shown. These views are to demonstrate the roll axis that the operator of the vehicle can move the blade. The roll axis is typically manipulated to produce an incline or sloped grade. The roll axis is controlled by hydraulic 36.

Figure 5:
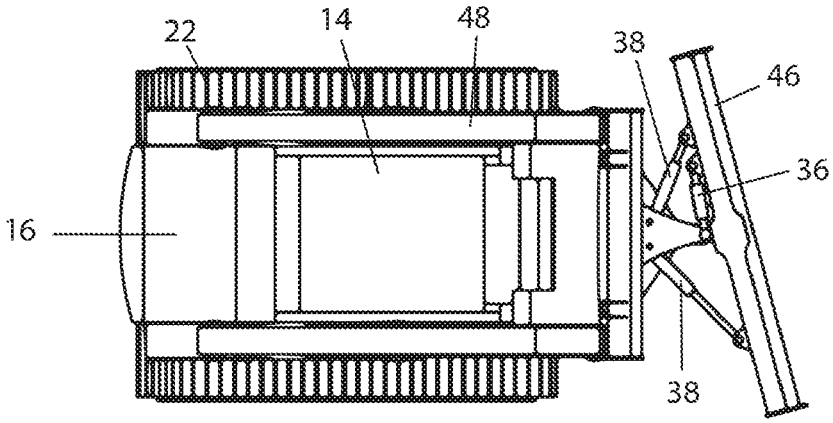
FIG. 5 is a top plan view demonstrating blade yaw left.
Figure 6:
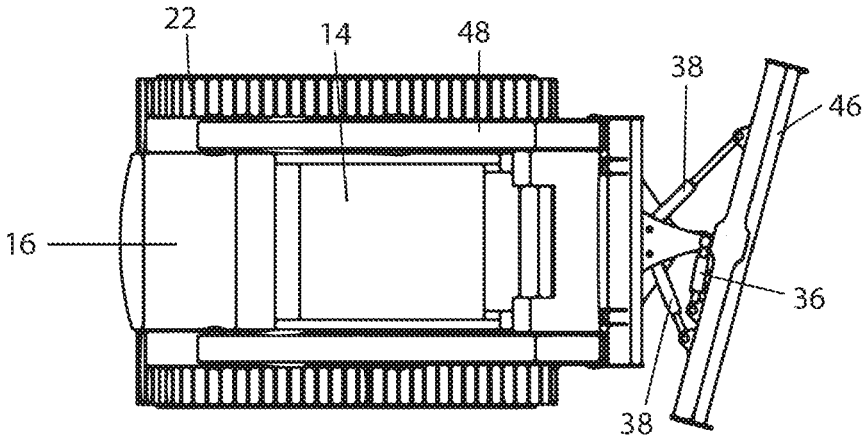
FIG. 6 is a top plan view demonstrating blade yaw right.

FIGS. 5 and 6 are a top plan view of a skid steer vehicle with a dozer blade attachment demonstrating the yaw axis that the operator of the vehicle can move the blade. The yaw axis is typically changed to push soil to one side of the skid steer vehicle. The change in yaw can be helpful in moving soil as part of the grading process. The yaw axis is controlled by hydraulics 38.

Figure 7:
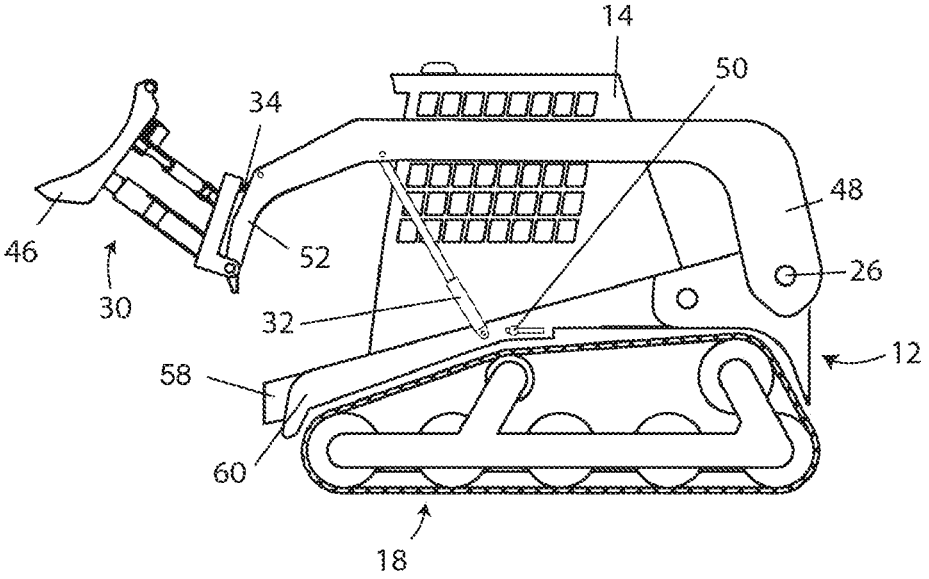
FIG. 7 is a side elevation view demonstrating a raised main arm.

FIG. 7 shows an example of the main arm 48 in a lifted configuration by extending the hydraulic 32. In this configuration the lock 62 is unlocked and the valve 50 is open allowing normal operation of the main arm 48 as the machine was intended from the manufacturer. FIG. 7 is not configured in accord with the present inventive concept while functioning to automatic grade. This figure merely demonstrates the capability of the machine when the present method of stabilizing the automatic grading system is not employed. In at least some versions of the invention the machine can easily be reconfigured to work as in FIG. 7 as might be needed for purposes other than GPS automatic grading while the valve 50 is open and the hydraulic 32 is active and the lock 62 is not securing the main arm 48.

Figure 8:
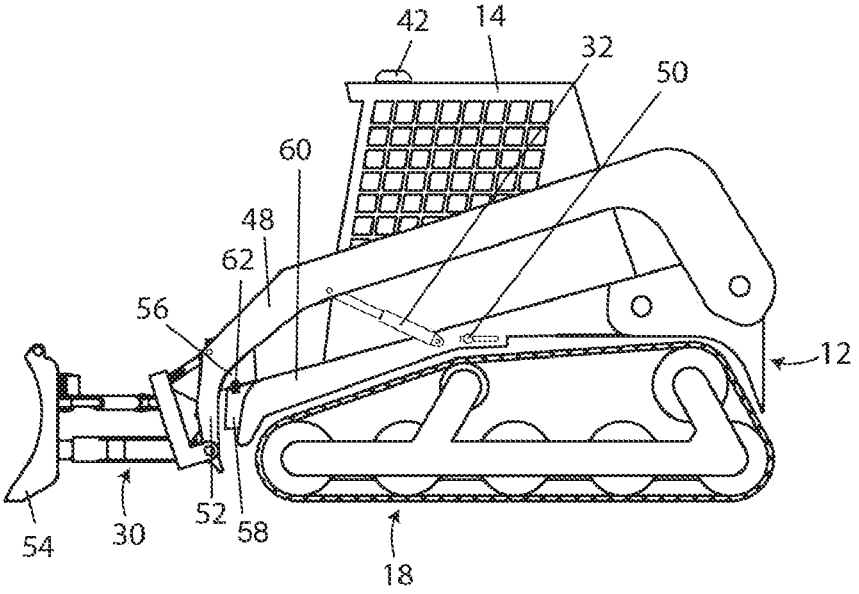
FIG. 8 is a side elevation view demonstrating lowered main arm and an alternate example of bracket.

FIG. 8 is a side elevation view of a skid steer vehicle with a dozer blade attachment demonstrating an alternate but equivalent means to secure the main arm 48 in a stable position. As discussed above, the hydraulic 32 is disabled by closing valve 50 or by the other hydraulic limiting means. In this version there is a bracket 56 affixed to the main arm 48 or other structure appurtenant thereto that interfaces with a stop 58 associated with the body 60 or other structural part of the vehicle. The combination of bracket 56 and stop 58 define a specific position that the main arm 48 is held at during the GPS automatic grading operations.

The use of the bracket 56 and stop 58 allow any brand, shape or configuration of skid steer to have a means to hold the main arm 48 at the required position to in turn hold the blade assembly 30 at the right height so that only the pitch axis of movement of the blade 46 affects how deep the blade 46 cuts and the automatic grading computer can effectively cut throughout the range of blade height needed.

The bracket 56 and stop 58 may be bolted or welded on the measured position of the machine and its main arm 48 so that the bottomed out main arm 48 is held at the right height. This may vary from make of machine to different models of the same make. A lock 62 is also optionally provided to secure the main arm 48 in place during automatic grading operations similar to the lock on other embodiments as disclosed in the examples given above.

Also similar to other versions above, the bracket 56 and stop 62 may be a plate, bracket or other structure securing more permanently the main arm 48 to the structure of the vehicle. Likewise the valve 50 could be traded for other means to prevent activation of the hydraulic 32 in addition to the bracket 56 and stop 58.

One commonly skilled in the art will appreciate a small to medium skid steer vehicle as contrasted to a larger dedicated purpose earthmoving vehicle such as a bulldozer.

One commonly skilled in the art will appreciate a small to medium skid steer vehicle may have either ground contacting tracks or wheels. In most environments a track style small to medium skid steer vehicle is preferred for its stability, traction and resistance to sinking in softer soils or creating ruts.

It should be appreciated that the inventive concepts can be maintained by including some or all parts from different variations of the embodiments described herein. The drawings are not intended to be specifically limiting to a single configuration giving rise to the inventive concept but are instead stylized illustrations of the important functions and features that may be encompassed in the greater inventive intent as apparent by this disclosure.

An important version of the invention can be fairly described as 1. A method for controlling a dozer blade controlled by an automatic grade control system on a skid steer vehicle comprising providing a skid steer vehicle having a main arm with a front side operably coupled to a dozer blade assembly. The skid steer is otherwise generally capable of having other front end attachments for other types of jobs. Then providing a stop connected to the skid steer vehicle upon which a point of the main arm rests thereby defining a lower limit of movement of the main arm. Essentially the main arm bottoms out at a preset height that is complimentary of the proper height that the dozer blade needs to be for its auto grading purposes. A bracket may be used to rest the main arm against or in some skid steer vehicles the body of the machine is at the appropriate height. A bracket and stop combination can be used to adapt any machine to bottom out at the right height for the pitch of the blade alone to control the continuous auto grading. Also, positioning the point of the main arm against the stop so it is bottomed out. Also, preventing the ability of the main arm from providing any lifting force by restricting the ability of a hydraulic that lifts the main arm. This essentially neuters the ability of the main arm to move up under power of the hydraulic that could normally otherwise lift the main arm. Also, operably connecting the automatic grade control system to a hydraulic that controls a pitch axis of movement of the dozer blade to affect a height of the dozer blade relative to a ground surface. The pitch axis of movement of the blade is this used to raise and lower the grade height as controlled by the automatic grading computer system. The method may further include locking the main arm against the stop when the main arm is at the lower limit of movement of the main arm. This can be by bracket, bolt, welding, pins, chains, clamp or other positive means to hold the main arm in place at its lowest allowed position as determined by the stop. The method may further including operating a valve to hydraulically isolate (hydraulically disconnect) the hydraulic lift actuator that lifts the main arm to further prevent any movement of the main arm. This essentially disconnects the main arm control from the system. This can also be achieved by disconnecting and capping off the hydraulic control for the main arm or by removing that hydraulic control completely.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method for controlling a dozer blade controlled by an automatic grade control system on a skid steer vehicle comprising:

providing a skid steer vehicle having a main arm with a front side operably coupled to a dozer blade assembly;

providing a stop connected to the skid steer vehicle upon which a point of the main arm rests thereby defining a lower limit of movement of the main arm;

positioning the point of the main arm against the stop;

preventing the ability of the main arm from providing any lifting force by restricting the ability of a hydraulic that lifts the main arm;

operably connecting the automatic grade control system to a hydraulic that controls a pitch axis of movement of the dozer blade to affect a height of the dozer blade relative to a ground surface.

2. The method for controlling a dozer blade as in claim 1 further including: locking the main arm against the stop when the main arm is at the lower limit of movement of the main arm.

3. The method for controlling a dozer blade as in claim 1 further including: operating a valve to hydraulically isolate the hydraulic lift that lifts the main arm to further prevent any movement of the main arm.

4. The method for controlling a dozer blade as in claim 3 further including: locking the main arm against the stop when the main arm is at the lower limit of movement of the main arm.

* * * * *